United States Patent [19]

Haug

[11] Patent Number: 4,944,073

[45] Date of Patent: Jul. 31, 1990

[54] PLUG FASTENER

[75] Inventor: Reinhold Haug, Königsbach-Stein, Fed. Rep. of Germany

[73] Assignee: J. Kohle GmbH & Co. KG, Pforzheim, Fed. Rep. of Germany

[21] Appl. No.: 437,849

[22] Filed: Nov. 15, 1989

[51] Int. Cl.[5] ..... A44B 13/00; A44C 11/02

[52] U.S. Cl. ..... 24/590; 24/616

[58] Field of Search ..... 24/590, 594, 599, 453, 24/616, 617; 403/342; 411/554

[56] References Cited

U.S. PATENT DOCUMENTS

| | | | |
|---|---|---|---|
| 2,291,975 | 8/1942 | Minero | 24/590 |
| 3,179,367 | 4/1965 | Rapata | 411/554 |
| 3,265,322 | 8/1966 | Whitehead | 242/130.2 |
| 3,744,101 | 7/1973 | Gley | 24/453 |
| 4,236,283 | 12/1980 | Marosy | 24/590 |
| 4,246,679 | 1/1981 | Monett | 24/590 |

FOREIGN PATENT DOCUMENTS

| | | | |
|---|---|---|---|
| 0197331 | 3/1986 | European Pat. Off. . | |
| 1008818 | 5/1952 | France | 24/590 |

*Primary Examiner*—Victor N. Sakran

*Attorney, Agent, or Firm*—Spensley Horn Jubas & Lubitz

[57] ABSTRACT

The socket of the plug fastener is formed in its inside peripheral surface with axial grooves and at their rear ends is formed with a gear, each of the teeth of which has an inclined driving tooth face. The plug of the plug fastener comprises a head piece, which is adapted to be axially spring-loaded in the socket and is formed with radial ribs and is rotatably mounted in a driving sleeve of the plug. That driving sleeve is provided on its outside peripheral surface with radially and axially extending ribs and has a forward end face formed with prismatic teeth. The plug is adapted to be inserted into the socket with the ribs of the head piece and the ribs of the driving sleeve sliding in axial grooves of the socket. When the head piece has been inserted into the socket beyond the gear the head piece is adapted to be rotated by two-step angular movements to first and second angular positions in alternation and in said first angular position is adapted to be axially pulled out of said socket and in said second angular position is locked in said socket. The first step of each of said angular movements is imparted to the head piece in that the teeth of the driving sleeve cooperate with beveled rear faces of the ribs of the head piece. The second step of each of said angular movements is imparted to the head piece in that the beveled rear faces of the ribs of the head piece cooperate with the inclined tooth faces of the gear of the socket during an axial displacement of the plug in the socket. As a result, the plug can be locked and unlocked in the socket in alternation in that the plug is repeatedly axially pushed into the socket as far as to a stop.

13 Claims, 4 Drawing Sheets

FIG. 2
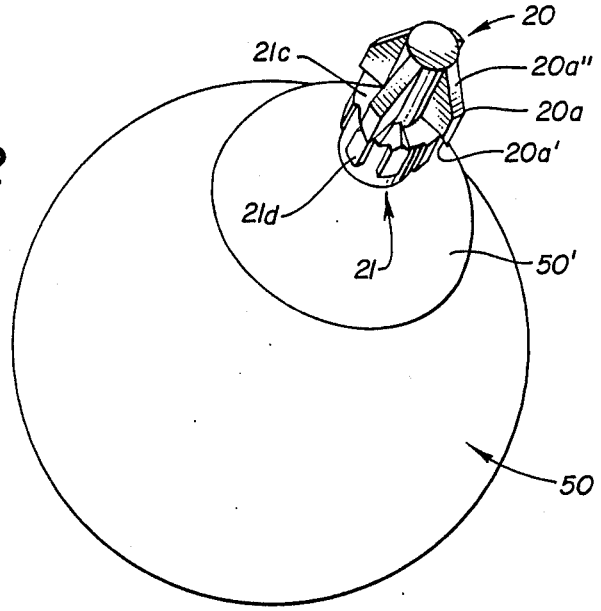
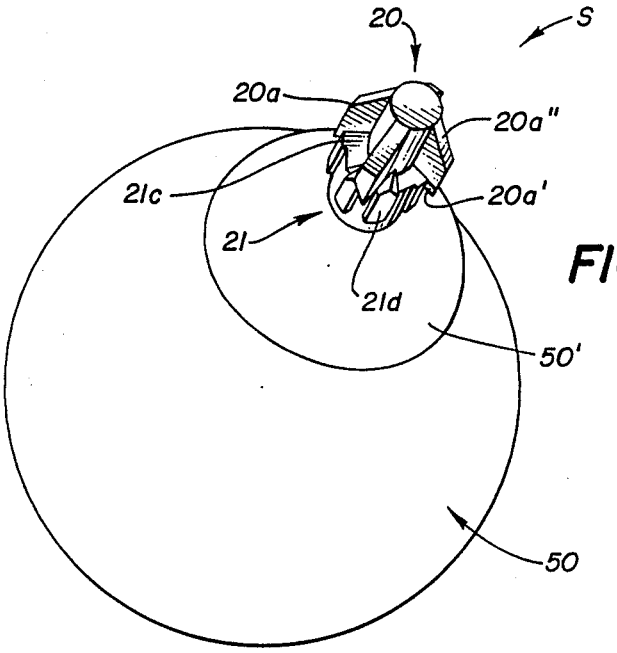
FIG. 3

PLUG FASTENER

BACKGROUND OF THE INVENTION

1. Field of the Invention

This invention relates to a plug fastener for an ornamental chain or the like, which fastener comprises a socket and a plug, which is adapted to be axially slidably inserted into the socket and includes a cylindrical stem, which as a result of axial displacements of the stem in the socket is adapted to interlock with rear locking surfaces of the socket and is to be released by said locking surfaces so that said stem can be extracted from the socket, which plug comprises a slider, which is axially slidably mounted on said stem for a movement between forward and rear end positions.

2. Description of the Prior Art

In a known plug fastener of that kind, which is known from EP 0 197 331, the plug already interlocks with the locking surfaces of the socket when the plug has performed a first part of its displacement. As the plug is inserted further to a stop the interlock is eliminated, as intended, as a result of an axial displacement which is positively imparted to the slider. In that known fastener the locking and unlocking actions are performed in succession during a displacement in the same direction and to effect an interlock the operator must interrupt that displacement after a first part thereof. For this reason, difficulties may arise in the operation of the fastener by persons who are not familiar with the nature of the fastener or are forgetful.

SUMMARY OF THE INVENTION

It is an object of the invention so to improve a plug fastener which is of the kind described first hereinbefore that the locking and unlocking of the fastener will be effected in alternation in that the plug is repeatedly inserted into the socket to the stop.

That object is accomplished in accordance with the invention in that the socket is internally formed with axial grooves and terminates at its rear end in a gear having teeth, each of which has an inclined tooth face, and the plug is provided with an unlocking member, which consists of a head piece, which serves also for effecting an interlock and is axially spring-biased and formed with radial and axial ribs and is rotatably mounted in a driving sleeve, which has radial and axial ribs and is provided with prismatic teeth at one end. As the plug is inserted into the socket the ribs of the head piece and the ribs of the driving sleeve are arranged to be positively moved into axially alignment with each other as said ribs enter the axial grooves of the socket upon an initial insertion of the plug into the socket. The head piece is adapted to be locked and unlocked in succession when it is rotated to perform a two-step angular movement after the ribs of the head piece have been moved beyond and out of the axial grooves. The first step of said angular movement is imparted to the head piece by the cooperation of the teeth of the driving sleeve and the faces of the ribs. The second step of the angular movement is imparted to the head piece by the cooperation of the beveled surfaces of the ribs and the driving tooth faces of the socket during a rearward axial displacement of the plug.

That design permits a simple manipulation. Besides, the plug fastener can take up high loads and is relatively wear-resistant.

The invention is not affected by the fact that it is known in other fields to provide coupling means or stepping mechanisms which are adapted to perform different functions in alternation as a result of alternate axial displacements. For instance, a plug coupling which is adapted to be locked and unlocked in alternation is known from U.S. Pat. No. 3,265,322, and stepping mechanisms are known for moving in writing utensils a writing element to a position for use and to a position of rest in alternation.

BRIEF DESCRIPTION OF THE DRAWING

FIG. 2 is a view which is similar to FIG. 1 and shows the plug of the plug fastener with the head piece and the driving sleeve in a relative position which is enforced as the plug has been inserted into the socket and guided in the axial grooves of the socket.

FIG. 3 is a view which is similar to FIG. 2 and shows the plug with the head piece in its rear position.

DETAILED DESCRIPTION OF THE PREFERRED EMBODIMENT

Figure 1:
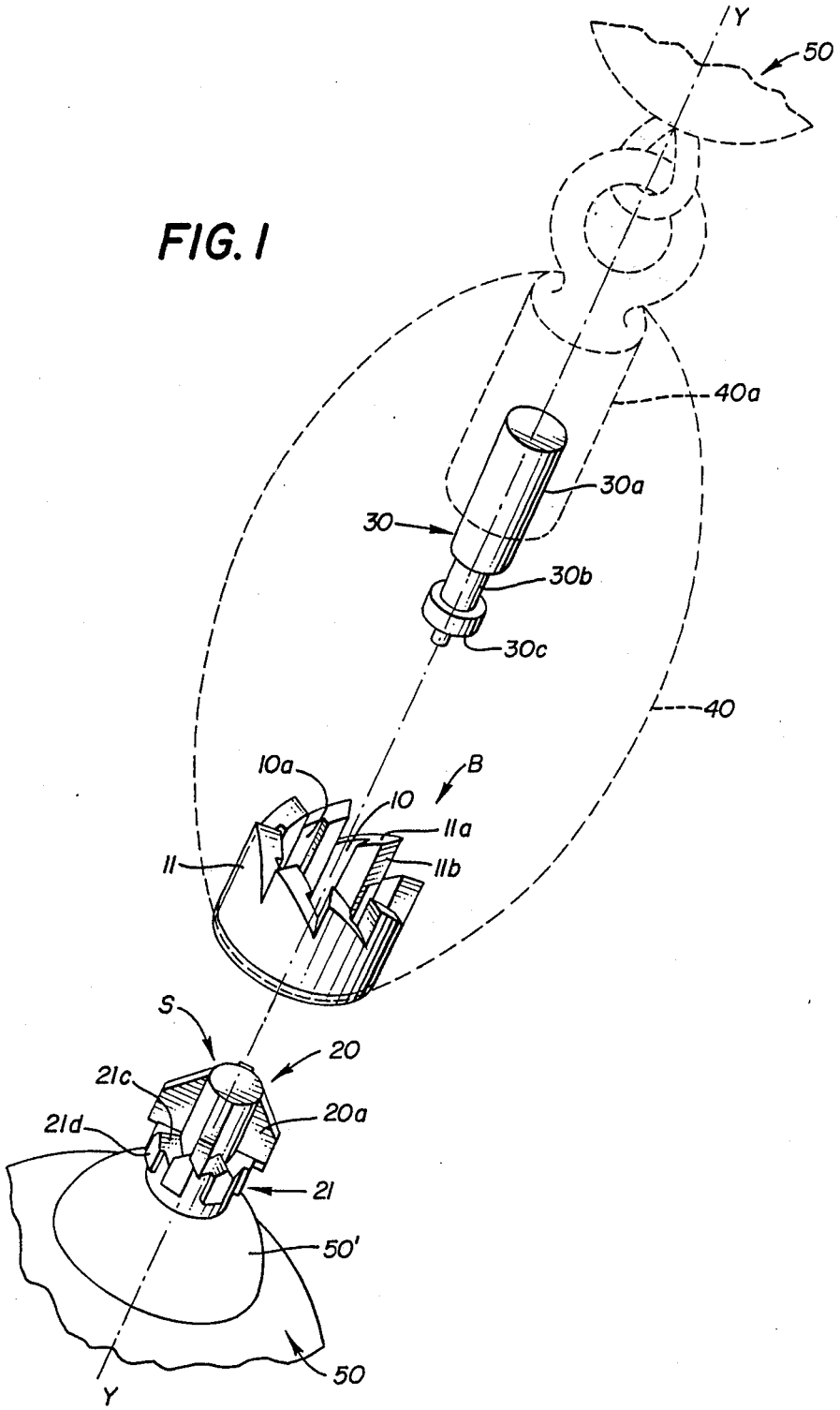
FIG. 1 is a perspective view showing the plug fastener in an open condition.

An illustrative embodiment of the invention will now be described more in detail with reference to the drawing.

In the embodiment illustrated in the drawing the plug fastener is provided on a necklace. But the plug fastener may be used also with other pieces of jewelry, such as bracelets, watch straps, or of apparel, e.g., as a belt fastener. The plug fastener comprises a socket B and a plug S, which is axially insertable into the socket. As a result of alternate axial displacements in the socket B, the plug S can be locked by rear edges of the socket and can be unlocked for being axially extracted. The socket B is formed on its inside surface with axial grooves 10 and at its rear end is terminated by a gear. Each tooth 11 of said gear has a tooth face **11*b* that is parallel to the axis of the socket B and a beveled tooth face, which will be described hereinafter as a driving tooth face 11*a*. As is diagrammatically illustrated in FIG. 1 the socket B is provided on the outside with an ornamental shell 40, to which the necklace or other ornamental brand 50 is connected by an articulated joint. A spring assembly 30 is secured in the socket on the axis y—y of the plug fastener and is spaced behind the teeth 11**. The spring assembly 30 comprises a bushing 30*a*, is fixedly received by a tubular portion 40*a* of the shell 40 and a steam 30*b*, which is provided with a radial flange 30*c* and is slidably mounted in the bushing 30*a* and is engaged at its rear end face by a coil spring. The head piece 20 of the plug S will be biased by the stem 30*b* as soon as the plug S is inserted into the socket B and the head piece 20 axially engages the stem 30*b* so that the associated coil spring will progresively be stressed as the stem 30*b* is axially displaced until the radial flange 30*c* engages the bushing 30*a*.

Figure 11:
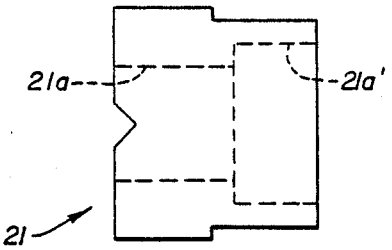
FIGS. 11 and 12 are, respectively, a side elevation and a perspective view showing the driving sleeve with the teeth, which are shown in a developed view in FIG. 13, being omitted for the sake of clearness.

The plug comprises the above-mentioned head piece 20 and a driving sleeve 21, which is fixedly connected to an adjacent, manually graspable part 50' of the piece of ornament. The head piece 20 is used to effect the interlock between the plug S and the socket B and the release the plug S and is formed on its outside peripheral surface with radial ribs 20*a* and by means of a stem 20*b* provided at its end with a radial flange 20*b*' is rotatably mounted in the driving sleeve 21 with an axial play. The stem 20*c* extends into a bore 21*a*, which is formed in the driving sleeve 21 and has a rear end portion 21*a*' which is relatively large in diameter, as is particularly apparent from FIG. 11.

The axial play permits the head piece 20 to be axially displaced in the driving sleeve between forward and rear end positions. In the forward end position the radial flange 20*b*' of the stem 20*b* engages an annular shoulder, which is provided at the transition from the portion 21*a*' of the bore 21*a* to a forward portion with is relatively small in diameter.

Figure 4:
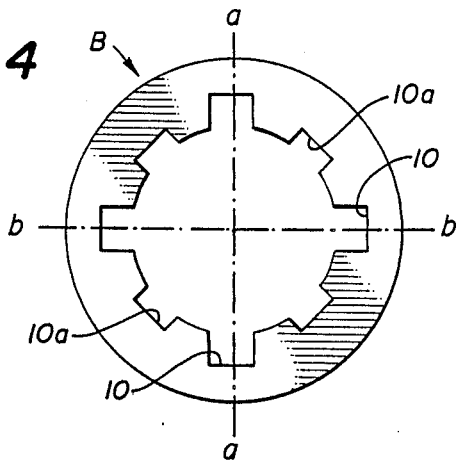
FIG. 4 is an end elevation showing the socket.

The socket B is formed in its inside peripheral surface with four axial grooves, which constitute two pairs disposed in mutually orthogonal planes a—a, b—b, as it particularly apparent from FIG. 4. Four additional axial grooves 10*a*, which have a smaller depth than the axial grooves 10, are formed in the inside peripheral surface of the socket B between the axial grooves 10. Each of the axial grooves 10*a* has an angular spacing of 45° from each adjacent axial groove 10.

The crests 21*c*' of the teeth 21*c* of the driving sleeve 21 has an angular spacing of 45°. The driving sleeve 21 is formed on its outside peripheral surface with axially extending radial ribs 21*d*, which are symmetrical to the tooth crests 21*c*' and during the axial displacements of the plug S in the socket B in mutually opposite directions are guided in the axial grooves of the socket B.

Figure 9:
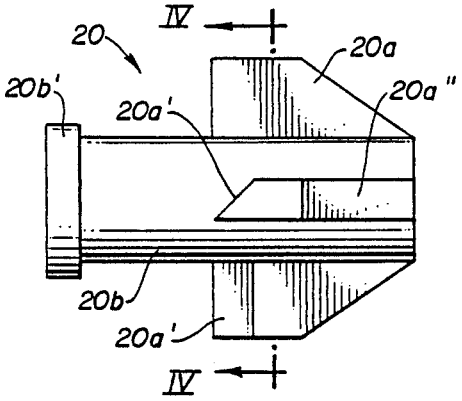
Figure 10:
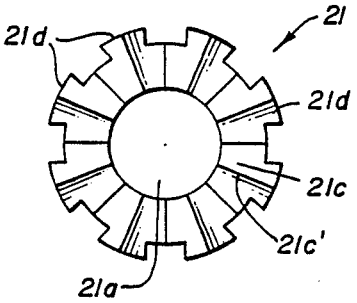
FIG. 10 is an end elevation showing the driving sleeve of the plug.

As is particularly apparent also from FIG. 9, the ribs 20*a* are provided at their rear end with beveled surfaces 20*a*', which extend radially with respect to the stem 20*b*. The ribs 20*a* are also provided at their forward end with beveled surfaces 20*a*'', which include an angle of about 45° with the axis y—y of the fastener so that the forward end engages of the ribs 20*a* are rearwardly inclined. The ribs 21*d* of the driving sleeve 21 have the same width as the ribs 20*a* of the head piece 20. The grooves 10*a* of the socket B have such a depth that they cannot axially be entered by the ribs 20*a* of the head piece 20 but can axially be entered by the ribs 21*d* of the driving sleeve 21.

Figure 12:
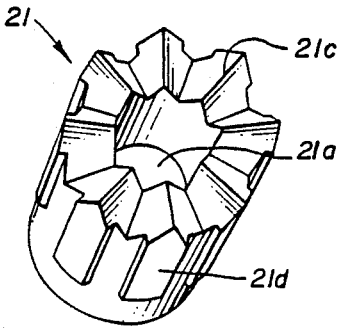
Figure 13:
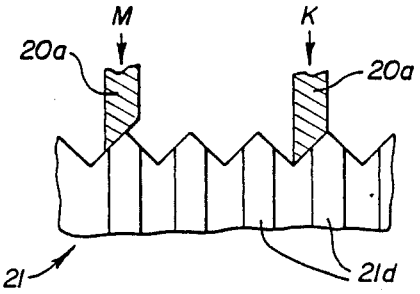
FIG. 13 is a developed view showing the teeth of the driving sleeve with the associated radial and axial ribs, with one of the radial and axial ribs of the head piece shown in two different operative positions (K and M).

The essential movements of the head piece 20 of the plug S will now be described. As the plug S is inserted into and extracted from the socket B, the plug member is locked and unlocked in alternation. Because the head piece 20 of the plug is freely rotatably mounted in the driving sleeve 21 when the plug fastener is open, the relative angular position of the head piece and the driving sleeve is not defined in that condition. In the position shown in FIG. 1 the relative angular position of the head piece 20 and the driving sleeve 21 is such that the ribs 20*a* are not axially aligned with the ribs 21*d* of the driving sleeve 21. As the plug S is inserted into the socket B the ribs 20*a* of the head piece 20 enter the axial grooves 10 of the socket after the hand moving the plug has substantially spontaneously imparted to the plug S an angular movement to the extent which is required to permit the ribs 20*a* to enter the axial grooves 10. As the plug S is inserted further into the socket B, the movement by which the ribs 21*d* enter the axial grooves 10 enforces a relative rotation between the driving sleeve 21 and the head piece 20, which is already guided in the axial grooves 10. That relative rotation is enforced because the beveled tooth faces of the teeth 21*a* which register with the ribs 21*d* engage edges disposed at the entrance portions of the axial grooves 10. Fig. 2 shows the head piece 20 and the driving sleeve 21 in the relative position in which the ribs 20*a* and 21*d* are aligned with each other and are guided by and held against rotation in the axial grooves 10 of the socket B. As the axial movement of the plug S is continued and the ribs 20*a* of the head piece 20 have moved beyond and out of the axial grooves 10, the head piece 20 is rotated through a center angle of 5 to 10 degrees owing to the axial pressure which is applied to the plug S as it is inserted because—as is apparent from FIG. 2—beveled tooth faces of the teeth 21*d* of the driving sleeve 21 under the axial pressure of the spring assembly 30 engage beveled faces 20*a*' of the ribs 20*a*. That first step of a two-step angular movement is imparted to the head piece 21 in that the beveled faces 20*a*' slide on the inclined tooth faces of the teeth 21*d* and causes the ribs 20*a* to move from a position which is designated K in FIG. 12 and in which they are aligned with the ribs 21*d* to a position which is designated M in Fig. 12 and in which the ribs 20*a* and 21*d* are no longer aligned. The movement which is manually imparted to the plug S in order to insert it into the socket B is limited in that the socket engages the part 50' of the piece of ornament.

Figure 5:
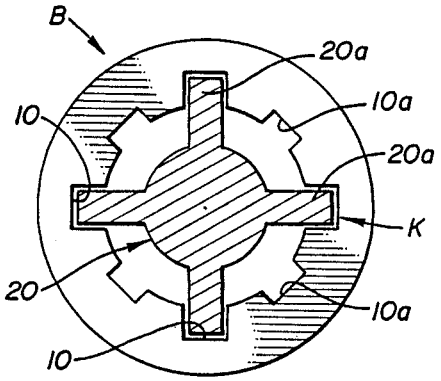
FIG. 5 shows the socket of the plug fastener with the inserted head piece, which is shown in a sectional view taken on line IV—IV in FIG. 9.
Figure 6:
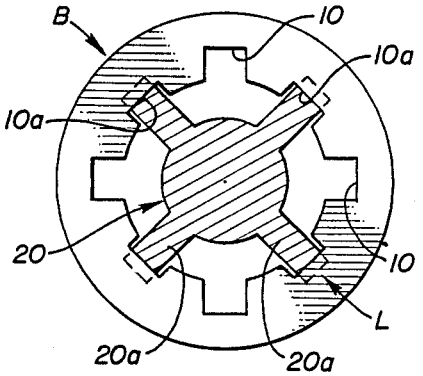
FIG. 6 shows the arrangement of FIG. 5 with the head piece in its locked position.
Figure 7:
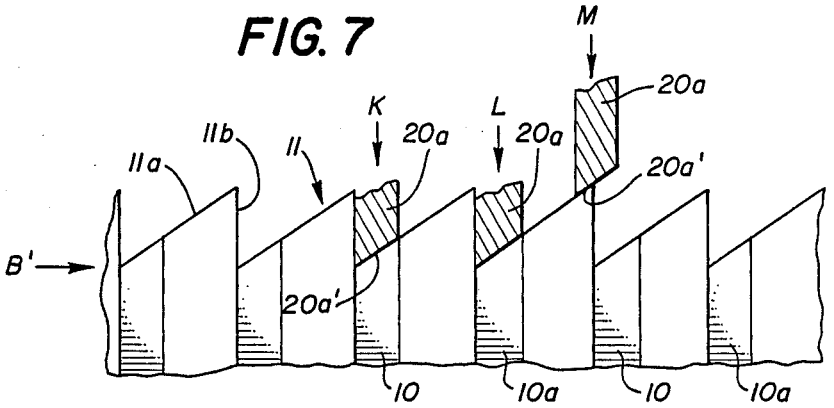
FIG. 7 shows the developed gear of the socket with three ribs of the head piece engaged in different operating positions K, L, M of the plug fastener.
Figure 8:
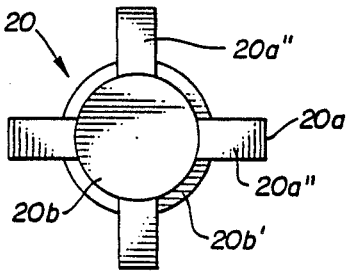
FIGS. 8 and 9 are, respectively, an end elevation and a side elevation showing the head piece of the plug.

When the plug S has been inserted into engagement with a stop, the head piece 20 is freely rotatable on the driving sleeve 21. Owing to that freedom of rotation the head piece 20 is moved by the first step of the angular movement described hereinbefore to such an angular position relative to the driving sleeve 21 and the socket B that the ribs 20*a* assume relative to the ribs 21*d* and to the tooth faces 11*a* of the teeth 11 of the socket B the position which is designated M in FIGS. 12 and 7. As is apparent from FIG. 7 the first step of the angular movement has had the result that the beveled surface 20*a*' can engage the tooth faces 11*a* under the bias applied by the spring assembly 30. Owing to that engagement a return movement which is now imparted to the plug assembly S by the spring assembly 30 permits a second, larger step of the angular movement to be imparted to the head piece so that the same has then performed a total angular movement of 45° and the ribs 20*a* will assume the locking position designated L and the unlocking position designated K in FIGS. 5 to 7 in alternation. In the locking position L the ribs 20*a* are aligned with the relatively shallow axial grooves 10*a*, which are formed in the socket B and an axial return movement of the head piece is thus prevented. In the unlocking position K the ribs 20*a* are aligned with the relatively deep axial grooves 10 of the socket so that the plug S can axially be extracted. As a result, when the ribs 20*a* of the head piece 20 of the plug have been moved beyond and out of the axial grooves 10 the head piece 20 can be locked and unlocked in alternation by two-step angular movements. The first step of each angular movement is imparted to the head piece in that the teeth 21c of the driving sleeve 21 cooperate with the beveled surfaces 20a' of the ribs 20a. The second step of each angular movement is imparted to the head piece by the cooperation of the beveled surfaces 20a' of the ribs 20 with the driving tooth faces 11a of the socket during a rearward axial displacement imparted to the plug S by spring force. It is seen that the fastener is closed in that the plug S is manually forced into the socket B until a stop is engaged and the plug is then moved to a locked position by spring force. When it is desired to open the fastener, the plug S must axially be forced into the socket B to a stop and must then axially be extracted. The first portion of the extracting movement is effected or imparted to the plug S by the spring assembly 30. The operator of the fastener will have the impression that the operation of the fastener resides in that the plug is locked and unlocked in alternation as it is repeatedly axially forced into the socket to a stop. The consecutive two-step angular movements which are imparted to the head piece 20 to lock and unlock the plug are identical. The difference between the locking and the unlocking sequence resides only in that the plug can be extracted through the axial grooves 10 off the socket from the position designated K in FIGS. 5 and 7 and the plug cannot be extracted from the position designated L in FIGS. 6 and 7 because in that position the ribs 20a of the head piece 20 are aligned with the axial grooves 10a, which are too shallow to receive the ribs 20a.

I claim:

1. In a plug fastener for an ornamental band having two ends, comprising a socket, which has a rear end and is adapted to be connected at said rear end to one end of said ornamental band and has an inside peripheral surface, which has an inner end axially spaced from said rear end of said socket and is formed with angularly spaced apart first axial grooves having a relatively large depth and with second axial grooves having a relatively small depth and disposed each between two adjacent ones of said first grooves, said socket being formed between said inner end of said inside peripheral surface and said rear end of said socket with an internal gear having teeth with taper toward said rear end of said socket and each of which has an inclined tooth face, spring means, which are mounted in said socket between said inner end of said inside peripheral surfaces and said rear end of said socket and comprise an axially movable stem, which faces said gear, and spring means urging said stem toward said gear, and a plug, which is adapted to be connected at one end to the other end of said ornamental band and which comprises a driving sleeve having a forward end, a central bore, which is open at said forward end, an outside peripheral surface formed with angularly spaced apart axial ribs, and at said forward end with angularly spaced apart teeth, each of which has an axially protruding crest, said plug also comprising a generally cylindrical head piece, which protrudes from said forward end of said sleeve and is rotatably mounted in said bore and is axially coupled to said sleeve with lost motion and has an outside peripheral surface formed with angularly spaced apart axial ribs having beveled rear end faces facing said sleeve, wherein said plug is adapted to be inserted into said socket to move said ribs of said head piece through said first axial grooves and beyond said gear until said head piece is disposed between said gear and said stem and into axial engagement with said stem to axially depress the same, said beveled rear faces of said ribs of said head piece are adapted to cooperate with said inclined tooth faces of said gear and with said teeth of said sleeve to impart a rotation to said head piece, said head piece is adapted to assume in said socket between said gear and said stem at least one first angular position, in which said ribs of said head piece are axially aligned with said first axial grooves, and at least one second angular position, in which said ribs of said head piece are axially aligned with said second axial grooves, the depth of said first axial grooves is sufficient to permit said ribs of said sleeve and said ribs of said head piece to axially enter said first axial grooves, the depth of said second axial grooves is sufficient to permit said ribs of said sleeve to axially enter said second axial grooves and is insufficient to permit said ribs of said head piece to axially enter said second axial grooves, and stop means are provided for limiting the movement of said plug in said socket toward said rear end of said socket in a position in which said stem is axially depressed by said head piece.

2. The improvement set forth in claim 1, wherein said first axial grooves consist of two pairs of grooves and said two pairs of grooves are arranged in axially and radially extending planes, which are at right angles to each other.

3. The improvement set forth in claim 2, wherein said second axial grooves consist of four grooves, each of which is spaced 45° from two adjacent ones of said first axial grooves.

4. The improvement set forth in claim 1, wherein said socket comprises an ornamental shell, which is concentric to said inside peripheral surface, and said spring means are radially symmetrical.

5. The improvement set forth in claim 4, wherein said socket comprises a tubular portion, which is mounted in said shell at said rear end of said socket and is open toward said gear and said spring means comprise a bushing and said stem is axially slidably mounted in said bushing and axially protrudes from said bushing toward said gear.

6. The improvement set forth in claim 1, wherein said teeth of said sleeve are spaces 45° apart and each of said teeth of said driving sleeve is symmetrically associated with one of said ribs of said sleeve.

7. The improvement set forth in claim 1, wherein each of said teeth of said gear of said socket has opposite to said inclined tooth face a second tooth face with is parallel to the axis of said socket.

8. The improvement set forth in claim 7, wherein said teeth of said socket are so arranged that said ribs of said head piece are axially movable into engagement with said inclined and said second tooth faces of respective ones of said teeth of said gear when said head piece is in each of said first and second angular positions.

9. The improvement set forth in claim 8, wherein said teeth of said sleeve are adapted to cooperate with said beveled surfaces of said ribs of said head piece to move said head piece to an at least one third angular position and said teeth of said gear are so arranged that said ribs of said head piece are axially movable into engagement only with part of said inclined tooth face of respective teeth of said gear when said head piece is in said third angular position.

10. The improvement set forth in claim 1, wherein said first and second axial grooves have the same width and said ribs of said sleeve and said ribs of said head piece have a width which corresponds to the width of said grooves.

11. The improvement set forth in claim 1, wherein said beveled end faces of said ribs of said head piece and said inclined tooth faces of said gear of said socket have the same inclination.

12. The improvement set forth in claim 1, wherein said inclined tooth faces of said gear are adapted to cooperate with said beveled surfaces of said ribs of said head piece to rotate said head piece to said first and second angular positions in alternation.

13. In a plug fastener for an ornamental band having two ends, comprising a socket, which has a rear end and is adapted to be connected at said rear end to one of said ornamental band and has an inside peripheral surface, which has an inner end axially spaced from said rear end of said socket and is formed with angularly spaced apart axial grooves, said socket being formed between said inner end of said inside peripheral surface and said rear end of said socket with an internal gear having teeth which taper toward said rear end of said socket and each of which has an inclined tooth face, said socket being formed between said inner end of said inside peripheral surface and said gear with stop faces facing said rear end of said socket and angularly spaced from adjacent ones of said axial grooves, spring means, which are mounted in said socket between said inner end of said inside peripheral surface and said rear end of said socket and comprise an axially movable stem, which faces said gear, and spring means urging said stem toward said gear, and a plug, which is adapted to be connected at one end to the other end of said ornamental band and which comprises a driving sleeve having a forward end, a central bore, which is open at said forward end, an outside peripheral surface formed with angularly spaced apart axial ribs, and at said forward end with angularly spaced apart teeth, each of which has an axially protruding crest, said plug also comprising a generally cylindrical head piece, which protrudes from said forward end of said sleeve and is rotatably mounted in said bore and is axially coupled to said sleeve with lost motion and has an outside peripheral surface formed with angularly spaced apart axial ribs having beveled rear end faces facing said sleeve, wherein said plug is adapted to be inserted into said socket to move said ribs of said head piece through said first axial grooves and beyond said gear until said head piece is disposed between said gear and said stem and into axial engagement with said stem to axially depress the same, said beveled rear faces of said ribs of said head piece are adapted to cooperate with said inclined tooth faces of said gear and with said teeth of said sleeve to impart a rotation to said head piece, said head piece is adapted to assume in said socket between said gear and said stem at least one first angular position, in which said ribs of said head piece are axially aligned with said axial grooves, and at least one second angular position, in which said ribs of said head piece are axially aligned with said stop faces, the depth of said axial grooves is sufficient to permit said ribs of said sleeve and said ribs of said head piece to axially enter said axial grooves, and stop means are provided for limiting the movement of said plug in said socket toward said rear end of said socket in a position in which said stem is axially depressed by said head piece.

* * * * *